United States Patent [19]

Walsh et al.

[11] Patent Number: 4,515,092

[45] Date of Patent: May 7, 1985

[54] ENHANCEMENT OF SOLID FUEL COMBUSTION BY CATALYST DEPOSITED ON A SUBSTRATE

[75] Inventors: Dennis E. Walsh, Richboro; Gary J. Green, Yardley, both of Pa.

[73] Assignee: Mobil Oil Corporation, New York, N.Y.

[21] Appl. No.: 569,816

[22] Filed: Jan. 11, 1984

[51] Int. Cl.[3] ..... F23D 1/00

[52] U.S. Cl. ..... 110/347; 110/342

[58] Field of Search ..... 110/342, 343, 344, 345, 110/347; 44/1 SR

[56] References Cited

U.S. PATENT DOCUMENTS

| | | | |
|---|---|---|---|
| 4,154,521 | 5/1979 | Mack et al. | 110/342 X |
| 4,191,115 | 3/1980 | Yang et al. | 110/218 X |
| 4,388,877 | 6/1983 | Molayem et al. | 110/342 |

*Primary Examiner*—Edward G. Favors

*Attorney, Agent, or Firm*—Alexander J. McKillop; Michael G. Gilman; Charles J. Speciale

[57] ABSTRACT

A combustion enhancing catalyst is deposited on a particulate refractory substrate such as sand. The solid fuel is contacted with the impregnated substrate and burned, for example, in a fluidized bed combustor. The substrate and catalyst remains in the combustor thereby obviating problems of catalyst loss and adverse effects of emitted metal particles.

9 Claims, 2 Drawing Figures

ENHANCEMENT OF SOLID FUEL COMBUSTION BY CATALYST DEPOSITED ON A SUBSTRATE

BACKGROUND OF THE INVENTION

This invention relates to the catalytic enhancement of solid fuel combustion and more particularly to the deposition of the catalyst on a substrate which remains in the furnace.

The catalytic oxidation effect of metals impregnated on solid carbonaceous fuels such as coal and coke has long been known. Such catalysts have been used in coal gasification as reported, for example, in "Application of Catalysts To Coal Gasification Processes, Incentives and Perspectives," Harald Juntgen, Fuel, February 1983, Vol. 62, p. 234.

While catalysts have been used in oxidation/gasification processes, they have not been widely used in combustion operations for the direct extraction of heat, such as in power plants and the like. One reason is that the catalyst is directly impregnated on the solid fuel, is quickly expended and is lost with ash removal. Catalysts have not been extensively used in industrial combustion operations due to concerns over the cost of catalyst loss and possible environmental effects of emitted metal particles.

It is an object of the present invention to deposit a combustion enhancing catalyst on a substrate which remains in a fluidized bed combustor thereby alleviating problems associated with catalyst loss.

It is another object of the present invention to burn solid fuel in a fluidized bed at a temperature which is low enough to allow catalytic influence, i.e., the higher activation energy thermal reactions will not completely overwhelm catalysis.

It is another object of the present invention to use catalysis to increase the throughput for a given unit size or permit the use of a smaller unit for a given duty.

It is another object of the present invention to obviate problems associated with direct impregnation of the catalysts on solid fuel.

SUMMARY OF THE INVENTION

A bed of low surface area inert solids, such as sand, contains an active metal catalyst which accelerates the burning rate and improves combustion efficiency when solid fuels are burned in fluidized bed combustion. The temperature range of fluid bed combustion is sufficiently moderate to allow catalytic effects to be operative. The use of catalysts on a substrate which remains in a fluidized bed minimizes concerns over the cost of catalyst loss and the possible environmental effects of emitted metal particles which have limited other attempts to catalytically enhance burning rates by direct impregnation of metals onto the solid fuel. Accelerated burning allows increased throughput for a given unit size or a smaller unit size for a given duty.

SHORT DESCRIPTION OF THE DRAWINGS

DESCRIPTION OF THE PREFERRED EMBODIMENT

The present invention is practiced in a furnace 11 which is charged with solid fuel. The solid fuel is introduced into a fluidized bed consisting of a particulate refractory substrate on which a combustion enhancing catalyst has been deposited. Since extensive internal surface area will be of no use because of the large relative size of the solid fuel particle vs. the diameter of a catalyst pore, a low surface area substrate is preferred. Sand, 80–240 mesh, is an excellent example of a refractory substrate with a low surface area. Generally, a substrate with a surface area of less than $\sim 5\ m^2/g$ is preferred for use. Other low surface area substrates which will withstand the temperature of combustion without being destroyed include, for example, $\gamma$-alumina, silicon carbide, and mullite.

In some instances the conversion of CO to $CO_2$ might be enhanced by using catalysts deposited on substrates of higher surface area as long as operating temperatures are not so high as to cause surface area loss ($< \sim 900°$ C.). In this case, the catalyst is deposited in the pores of the substrate where it can be readily contacted with evolving CO for conversion to $CO_2$. Examples of such substrates include high surface area silica alumina, $\gamma$-alumina, and silica. A mixture of substrates impregnated with catalysts may usefully be employed in many instances. For example, a mixture of low surface area sand with high surface area $\gamma$-alumina, both substrates being impregnated with a catalyst, may usefully be employed under moderate combustion conditions.

Catalysts which are suitable for use in practicing the invention include noble metals, transition metal oxides and alkali metal oxides such as Pt, NiO, CoO and $Na_2O$.

Figure 1:
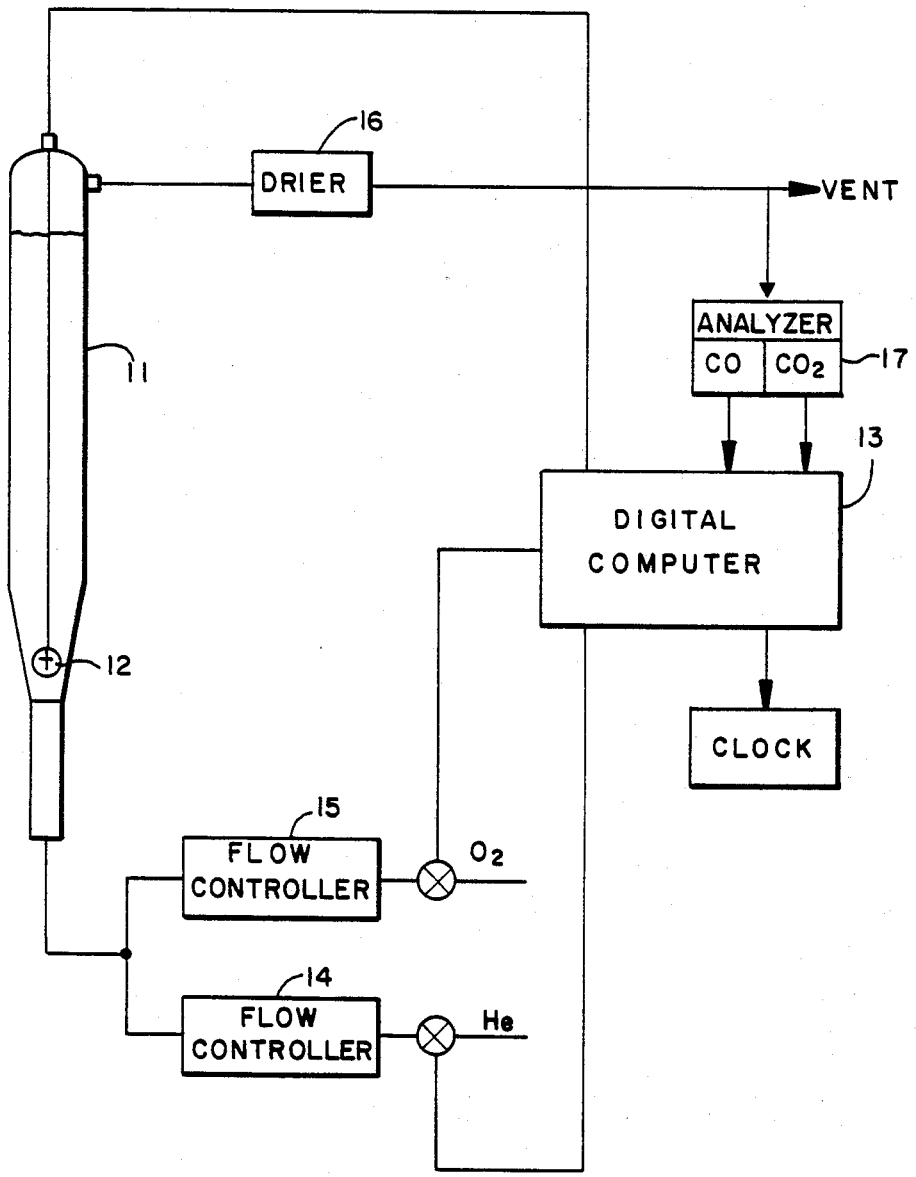
FIG. 1 shows a furnace for practicing this invention.

Referring again to FIG. 1, a thermocouple 12 provides an indication of temperature to the digital computer 13. When burning solid fuel in accordance with the present invention, the temperature in the furnace should be maintained in the range of 400° C. to 850° C. The combustor containing the catalytic fluidized bed is charged with the solid fuel. This bed is fluidized by the oxidizing gas mixture, for example, oxygen and helium. Helium is supplied through flow controller 14 and oxygen is supplied through flow controller 15.

In order to analyze the reaction product yields from the furnace, the reaction gases are supplied through drier 16 to the analyzer 17 which typically is a nondispersive infrared $CO/CO_2$ analyzer. Signals representing CO and $CO_2$ content in the reaction gases are supplied to digital computer 13, which subsequently computes burning rate information.

EXAMPLES

Tests of catalysts and solid fuel were carried out in a vycor reactor, 20" long and 1.5" wide in diameter. Oxygen and helium fluidizing gas entered through a frit at the base of the tapered section of the reactor bottom.

0.1–10 wt.% of the solid fuel to be burned was added to a sand bed (140 g, 80–240 mesh) in the reactor. The mixture was fluidized and brought to the combustion temperature of interest in He. The experiment was then initiated and monitored by a HP 9825B minicomputer. 100% $O_2$ was used in all experiments as the oxidizing gas. Combustion gases leaving the fluid bed were analyzed on line by an infrared monitor, the observed CO and $CO_2$ concentrations being recorded by the computer as a function of time.

Investigation of catalytic materials was accomplished by impregnation of the sand using aqueous solutions containing a quantity of metal sufficient to provide the desired loading (generally $\sim 1$ wt.%). The dried preparations were then $O_2$ calcined at ~600° C. prior to use. When Pt preparations were made (from $H_2PtCl_6$), dried samples were hydrogen reduced (2 hours at 425° C.) prior to $O_2$ calcination.

Petroleum coke was the solid fuel and included sponge and needle cokes from delayed coking as well as fluid coke. All coke samples were nitrogen calcined for 1 hour at 600° C. to remove residual volatile matter which might complicate data interpretation. Particle sizes studied ranged from 60/80 mesh to 300/325 mesh and were chosen so that all burning rate data showed no evidence of diffusional influences. Coke analyses are shown in Table 1.

TABLE 1

| | Needle Coke | Sponge Coke | Fluid Coke |
|---|---|---|---|
| C (wt %) | 93.8 | 90.4 | 87.3 |
| H | 2.4 | 1.7 | 1.6 |
| O | 2.3 | 1.7 | 1.6 |
| N | 0.48 | 1.1 | 1.2 |
| S | 0.54 | 3.68 | 8.0 |
| Ash | 0.53 | 1.17 | .33 |
| Ni (ppm) | 20 | 145 | 275 |
| V | 25 | 390 | 540 |
| Cu | 5 | 7 | 5 |
| Fe | 200 | 215 | 60 |

Figure 2:
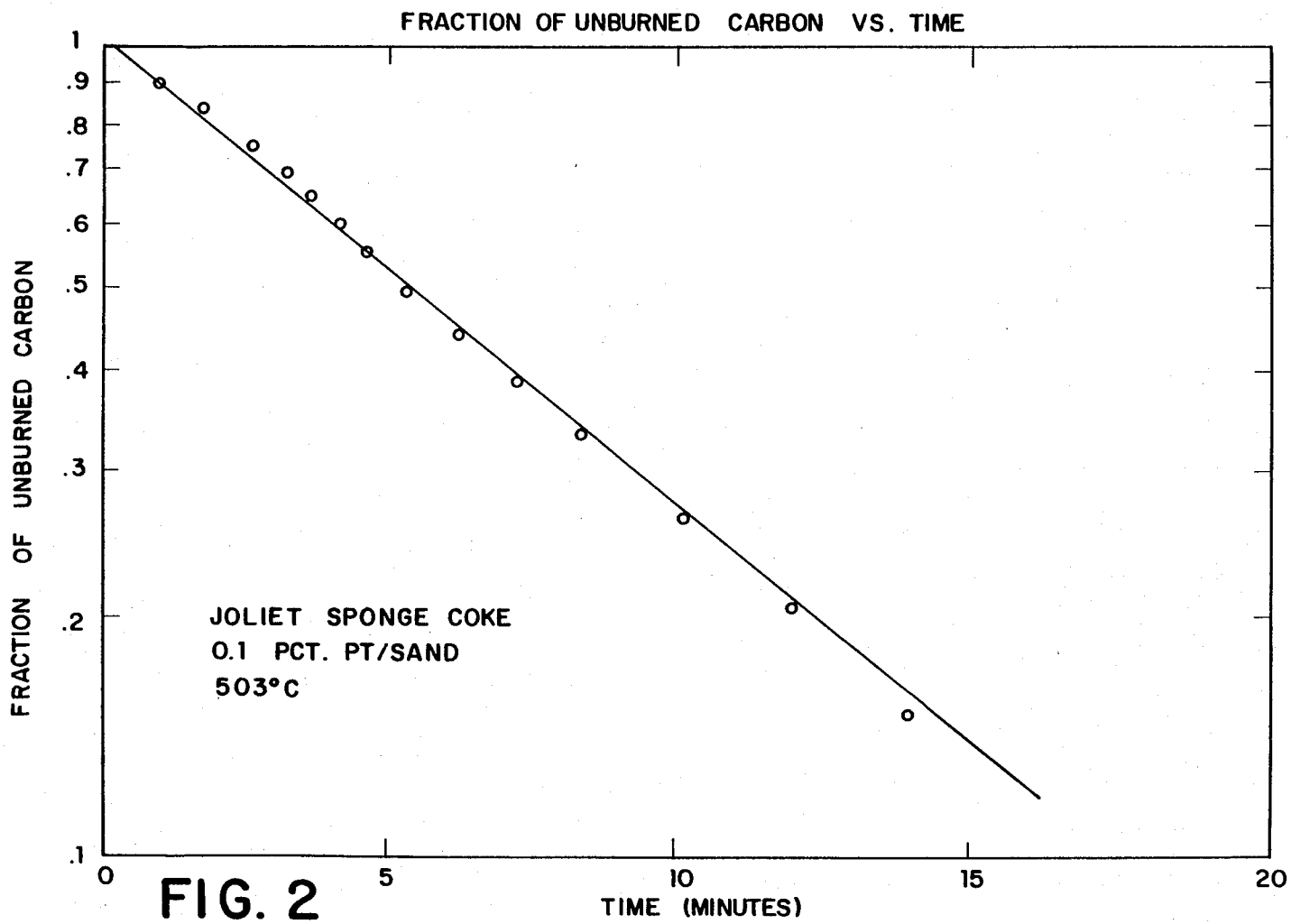
FIG. 2 shows the fraction of unburned carbon vs. time.

The burning rate data were adequately represented by first order kinetics over 80% of the burnoff. FIG. 2 presents a representative plot of the natural log of the fraction of unburned carbon vs. time which is reasonably well fit by a straight line, the slope of which is the rate constant.

Non-catalytic baseline data, as well as catalytic results for needle, sponge and fluid cokes are presented in Table 2.

TABLE 2

BURNING RATE CONSTANTS ($min^{-1}$) AND RATE CONSTANT RATIOS (505° C.)

| Fluid Bed | Needle Coke | $k_{cat}/k_{sand}$ | Sponge Coke | $k_{cat}/k_{sand}$ | Fluid Coke | $k_{cat}/k_{sand}$ |
|---|---|---|---|---|---|---|
| Sand | 0.095 | 1.0 | .154 | 1.0 | 0.157 | 1.0 |
| 1% Pt/Sand | 0.215 | 2.3 | .220 | 1.4 | 0.243 | 1.5 |
| 1% NiO/Sand | 0.221 | 2.3 | .216 | 1.4 | — | — |
| 1% Cobalt Oxide Sand | 0.182 | 1.9 | — | — | — | — |
| 1% $Na_2O$/Sand | 0.260 | 2.7 | — | — | — | — |

When needle coke was burned over clean sand the burning rate constant was 0.095. When the sand was impregnated with 1% by weight of platinum, the burning rate constant was 0.215. This is an improvement of 2.3 times. Similarly, the impregnation of sand with 1% by weight of NiO produced a rate enhancement of 2.3. Cobalt oxide and $Na_2O$ impregnated sand produced burning rate enhancements of 1.9 and 2.7 respectively for needle coke. The burning rate enhancement for sponge coke was 1.4 with platinum or NiO. The burning rate enhancement of fluid coke was 1.5 when sand was impregnated with platinum.

Therefore, at the comparison temperature of 505° C. all the catalytic materials tested produced a burning rate enhancement and the degree of enhancement depended upon coke type.

The data in Table 3 present the $CO/CO_2$ ratio in the combustion gases at 50% carbon burnoff for needle coke oxidation.

TABLE 3

$CO/CO_2$ RATIO AT 50% NEEDLE COKE BURN-OFF (505° C.)

| Catalyst | $CO/CO_2$ |
|---|---|
| None | 0.64 |
| .1% Pt | 0 |
| 1% Pt | 0 |
| 1% NiO | 0 |
| 1% CoO | 0 |
| 1% $Na_2O$ | 0.67 |

In all baseline cases both CO and $CO_2$ were produced over the course of the burn in fairly fixed proportions, while in all Pt and transition metal experiments CO was never observed, indicating more efficient combustion. The similarity of the $CO/CO_2$ ratio for the baseline data and sodium oxide data indicates that the alkali metal oxide enhances gasification of carbon to $CO_x$ but does not effectively improve combustion efficiency by promoting conversion to $CO_2$.

The above data clearly indicates the ability of a catalytic bed to accelerate the rate of coke burning and, when using noble metals or transition metal oxides, to increase conversion of CO to $CO_2$, i.e., increase combustion efficiency.

Elemental analyses carried out on the catalytic bed before and after combustion testing showed identical catalyst concentrations. Furthermore, negligible entrainment losses were observed.

While a particular embodiment of the invention has been shown and described, various modifications are within the true spirit and scope of the invention. The appended claims are, therefore, intended to cover all such modifications.

What is claimed is:

1. A method of burning solid fuel comprising:
depositing a catalyst which enhances combustion by impregnating a particulate refractory substrate;
contacting a solid fuel with said particulate refractory substrate; and
burning said fuel.

2. The method recited in claim 1 further comprising:
fluidizing said substrate and fuel in a fluidized bed combustor; and
burning said fuel in said fluidized bed.

3. The method recited in claim 1 wherein said fuel is petroleum coke.

4. The method recited in claim 1 wherein said particulate refractory substrate is sand.

5. The method recited in claim 1 wherein said particulate refractory substrate has a low surface area, less than ~5 $m^2/g$.

6. The method recited in claim 1 wherein said catalyst is a noble metal or a transition metal oxide.

7. The method recited in claim 1 wherein said catalyst is an alkali metal oxide.

8. The method recited in claim 1 wherein said catalyst is selected from the group consisting of Pt, NiO, CoO, and $Na_2O$.

9. The method recited in claim 1 wherein said solid fuel is contacted with a catalyst deposited on a particulate refractory substrate blend having components with different surface areas.

* * * * *